US005825133A

United States Patent [19]

Conway

[11] Patent Number: 5,825,133

[45] Date of Patent: Oct. 20, 1998

[54] RESONANT INVERTER FOR HOT CATHODE FLUORESCENT LAMPS

[75] Inventor: David W. Conway, Cedar Rapids, Iowa

[73] Assignee: Rockwell International, Costa Mesa, Calif.

[21] Appl. No.: 719,935

[22] Filed: Sep. 25, 1996

[51] Int. Cl.[6] ..... H05B 37/02

[52] U.S. Cl. ..... 315/105; 315/176; 315/172

[58] Field of Search ..... 315/105, 106, 315/107, 176, 172

[56] References Cited

U.S. PATENT DOCUMENTS

| | | | |
|---|---|---|---|
| 2,337,992 | 12/1943 | Hall, Jr. et al. | 315/99 |
| 4,283,249 | 8/1981 | Garcia et al. | 363/48 |
| 4,346,332 | 8/1982 | Walden | 315/317 |
| 4,370,600 | 1/1983 | Zansky | 315/244 |
| 4,704,560 | 11/1987 | Mills et al. | 315/169.3 |
| 4,920,299 | 4/1990 | Presz et al. | 315/105 |
| 4,998,045 | 3/1991 | Ruby | 315/209 |
| 5,027,034 | 6/1991 | Ruby et al. | 315/106 |
| 5,130,605 | 7/1992 | Ogawa et al. | 315/105 |
| 5,420,481 | 5/1995 | McCanney | 315/291 |

*Primary Examiner*—Benny Lee
*Assistant Examiner*—Michael Shingleton
*Attorney, Agent, or Firm*—Kyle Eppele; James P. O'Shaughnessy

[57] ABSTRACT

A fluorescent lamp drive circuit is disclosed. The fluorescent lamp drive circuit includes first filament drive circuitry coupled to the filaments of the lamp for driving the fluorescent lamp with a first waveform having sufficient amplitude such that gases in the fluorescent lamp are not allowed to extinguish during a prolonged period of operation. The fluorescent lamp drive circuit also includes second filament drive circuitry coupled to the filaments of the lamp for adjustably driving the fluorescent lamp with a second waveform during the prolonged period of operation. The second waveform has an amplitude which is adjustable over a wide range of voltages to achieve a wide range of fluorescent lamp luminance levels. Synchronization circuitry provides an input to the second filament drive circuitry to automatically facilitate the efficient transfer of power from the second filament drive circuitry to the fluorescent lamp over a wide range of lamp pressures and operating temperatures.

10 Claims, 6 Drawing Sheets

RESONANT INVERTER FOR HOT CATHODE FLUORESCENT LAMPS

BACKGROUND OF THE INVENTION

The present invention relates to backlighting systems for liquid crystal displays. More particularly, the present invention relates to a fluorescent lamp drive circuit or system which allows the fluorescent lamp to be dimmed while simultaneously extending the operational life of both the fluorescent lamp and of the drive circuit components. The fluorescent lamp drive circuit of the present invention automatically adapts to the properties of the driven lamp to optimize the efficiency of energy transfer to the fluorescent lamp over a wide range of fluorescent lamp gas pressures and operating temperatures.

Prior art on fluorescent lamp drive circuits have a number of constraints and deficiencies which limit their ability to effectively control dimming of the fluorescent lamp over a wide luminance range, and which in some designs greatly reduce the operational life of the fluorescent lamp and of the components of the drive circuit. Many conventional fluorescent lamp drive circuits are types of current fed or resonant inverters. A discussion of current fed inverters of this type can be found in Hnatek, Design of Solid-State Power Supplies, Second Edition, 1980, page 466. The most basic current fed inverters use a transformer with a DC voltage source coupled, through an inductor referred to as a feed choke, to a center-tap on the primary side of the transformer. A separate semiconductor switch or transistor is coupled to each of two transformer connections on the primary side. Conduction of the two switches is alternated to form a square wave having a constant current value and a constant frequency. The fluorescent lamp, which is coupled to the secondary of the transformer, is thus driven with the constant amplitude sinusoidal waveform resulting at the secondary.

Basic current fed inverters of this type lack the capability to increase or decrease the luminance of the fluorescent lamp by increasing or decreasing the amplitude of the sinusoidal waveform which ultimately drives the filaments of the lamp. Further, they also lack the capability to adapt to changing lamp impedances. The pressure of the gas inside the lamps differs significantly from one lamp to the next as a result of variations in the manufacturing process. Because of gas pressure variation between lamps, there are commonly significant differences in impedance between lamps created using the same manufacturing process. As a result, prior art current fed inverters typically have to be individually tuned for the impedance of a specific fluorescent lamp. If the lamp is replaced, the circuit must be re-tuned. Further, the impedance of any individual lamp itself changes as the operating temperature of the lamp changes, thereby changing the pressure of the gases in the lamp. Variations in lamp impedance or load can result in changes in the frequency of the sine waveform produced at the secondary of the transformer of the current fed inverter. Therefore, even if the drive circuit is tuned for a particular lamp, variations in operating temperature can still shift the frequency of the sinusoidal waveform and thus make energy transfer to the lamp less efficient. Prior art attempts to design fluorescent lamp drive circuits capable of adjusting for changing lamp impedances requiring difficult to implement software and/or look-up tables to anticipate the needed changes. In addition to not working well, these designs increase the cost of the drive circuit significantly.

Some fluorescent lamp drive circuits employ a pre-regulator or "buck" stage to feed the current fed inverter, thus allowing the luminance of the driven fluorescent lamp to be adjusted. Drive circuits of this type strike the arc in the lamp with a high voltage pulse to get the lamp started, and then a dampened or decaying sinusoidal waveform drives the lamp until it rings out to zero volts. The gases are thus allowed to extinguish after each high voltage pulse before the drive circuitry strikes the arc of the lamp again. Brightness is controlled by controlling the time period between consecutive high voltage pulses used to strike the arc in the lamp.

These "dimmable" types of fluorescent lamp drive circuits have several disadvantages as well. Repeatedly exposing the lamp to high voltage pulses causes premature breakdown of both lamp cathode emissive material and drive circuitry components. This in turn greatly reduces the life expectancy of the backlighting system. Also, like the basic current fed inverter described above, the luminance adjustable two stage current fed inverters lack the ability to adapt to changes in lamp impedance. As a result, energy is not efficiently transferred from the drive circuit to the lamp if the lamp impedance changes.

Therefore, there is a need for a low cost fluorescent lamp drive system for supplying power to a fluorescent lamp such that the lamp can be dimmed and brightened over a wide range of luminance levels without over stressing the lamp and circuit components with repeated high voltage pulses. Further, there is a need for a fluorescent lamp drive circuit which can automatically adjust to efficiently supply power to fluorescent lamps having a wide range of impedances.

SUMMARY OF THE INVENTION

It is an object of the present invention to provide a fluorescent lamp drive system which can adjust the luminance of the driven lamp over a wide range while simultaneously reducing lamp and drive system component failures by reducing their exposure to high voltage pulses. It is a second object of the present invention to provide a fluorescent lamp drive system which automatically adjusts to efficiently supply power to fluorescent lamps having a wide range of impedances. The present invention achieves these and other objects discussed throughout this application.

A fluorescent lamp drive system or circuit is disclosed. The fluorescent lamp drive system includes first filament drive circuitry coupled to the filaments of the lamp for driving the fluorescent lamp with a first low voltage waveform having sufficient amplitude such that gases in the fluorescent lamp are prevented from extinguishing during a prolonged period of operation. The fluorescent lamp drive circuit also includes second filament drive circuitry coupled to the filaments of the lamp for adjustably driving the fluorescent lamp with a second waveform during the prolonged period of operation. The second waveform has an amplitude which is adjustable over a wide range of voltages to achieve a wide range of fluorescent lamp luminance levels. Synchronization circuitry provides an input to the second filament drive circuitry to automatically facilitate the efficient transfer of power from the second filament drive circuitry to the fluorescent lamp over a wide range of lamp pressures and operating temperatures.

BRIEF DESCRIPTION OF THE DRAWINGS

The invention may be more fully understood by reading the following description of a preferred embodiment of the invention in conjunction with the appended drawings wherein.

DETAILED DESCRIPTION OF THE PREFERRED EMBODIMENTS

Figure 1:
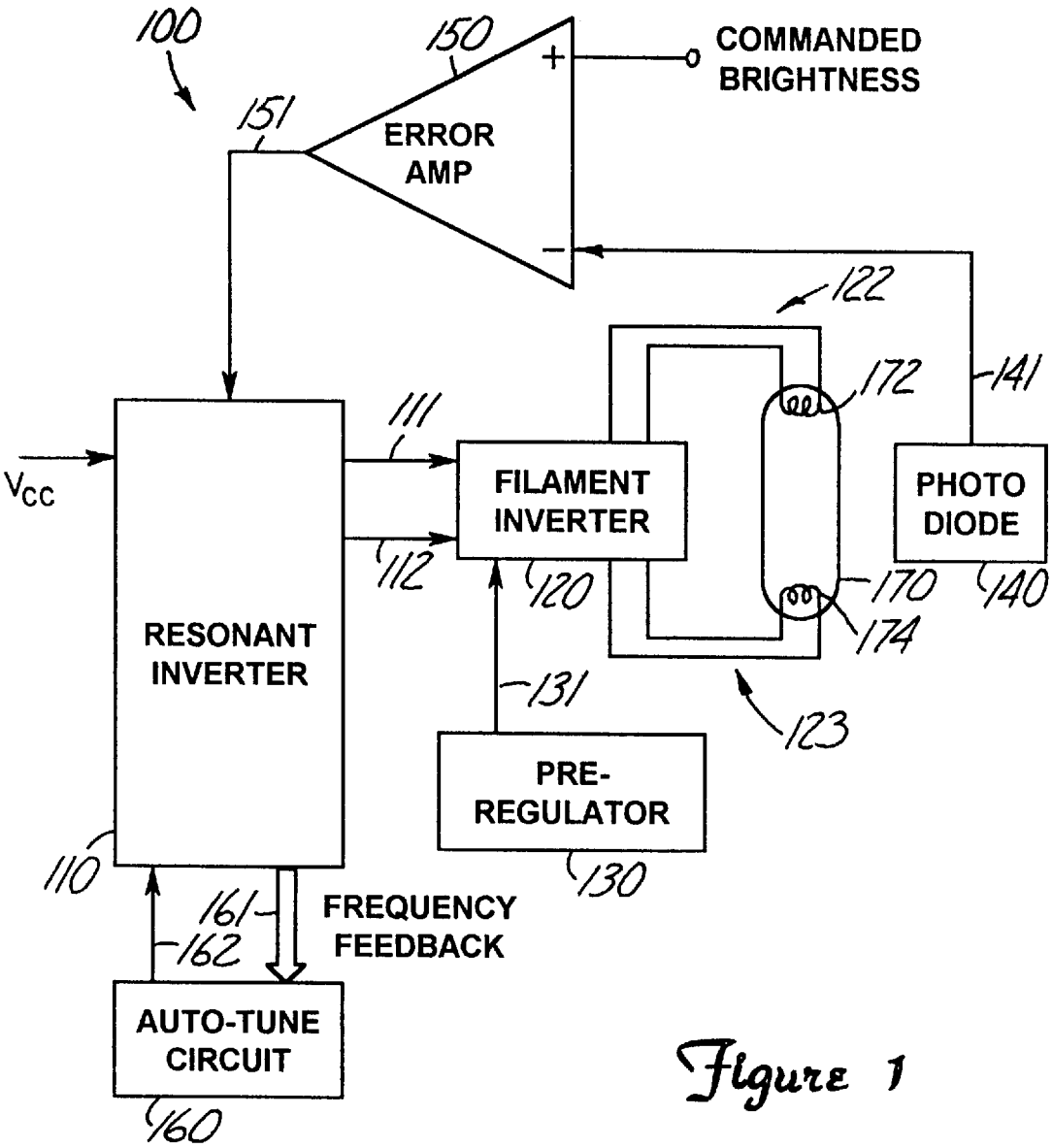
FIG. 1 is a block diagram of the fluorescent lamp drive system of the present invention.

FIG. 1 is a block diagram of fluorescent lamp drive system or circuit 100 of the present invention. In the preferred embodiment of the present invention illustrated in FIG. 1, fluorescent lamp drive system 100 includes current fed or resonant inverter 110, filament inverter 120, pre-regulator 130, photodiode 140, error amplifier 150, and auto-tune circuit 160. Fluorescent lamp drive system 100 is used to adjustably drive fluorescent lamp 170 over a wide luminance range. Fluorescent lamp drive system 100 also optimizes the efficiency of the energy transfer process as the impedance of lamp 170 changes.

Resonant inverter 110 is coupled to voltage source Vcc from which it receives power for conversion to a high voltage sinusoidal or near sinusoidal waveform which is used to drive filaments 172 and 174 of lamp 170. Resonant inverter 110 is also coupled to output 151 of error amplifier 150, to filament inverter 120 through resonant inverter outputs 111 and 112, and to auto-tune circuit 160 through frequency feedback 161 and auto-tune output 162. Filament inverter 120 is coupled to, and receives inputs from, resonant inverter 110 and pre-regulator 130. Filament inverter 120 is also coupled to filaments 172 and 174 of lamp 170 through filament inverter outputs 122 and 123, respectively. Filament inverter 120 drives lamp 170 with a low voltage waveform having a sufficient voltage magnitude that filaments 172 and 174 of lamp 170 are maintained in an excited state, and such that the gases inside of lamp 170 are not allowed to extinguish. Photodiode 140 is optically coupled to lamp 170. Output 141 of photodiode 140 is coupled to the negative input of error amplifier 150. The positive input of error amplifier 150 is coupled to a Commanded Brightness input signal. The output of error amplifier 150 is provided to resonant inverter 110 to control the amplitude of the high voltage waveform, and to thereby control the luminance of lamp 170.

Resonant inverter 110 is of the type known in the art which receives DC input voltage Vcc and provides a high voltage waveform at or across outputs 111 and 112. DC input voltage Vcc can be any of a wide range of voltages, but in the preferred embodiment of the present invention, DC input voltage Vcc varies between about 18 volts and about 32 volts. As discussed below in greater detail, the amplitude of the waveform at or across outputs 111 and 112 can be adjusted over a wide range to control the luminance of fluorescent lamp 170, but will typically be between about 250 volts and 400 volts peak to peak. The frequency of the waveform can also vary due to factors such as changes in the impedance of lamp 170.

Filament inverter 120 is preferably a driven square waveform inverter. Filament inverter 120 receives a DC input voltage of between about 5 volts and 8 volts from output 131 of pre-regulator 130, and provides a square wave of approximately the same amplitude at filament inverter outputs 122 and 123. The low voltage waveform provided by filament inverter 120 on outputs 122 and 123 has a frequency which is approximately one half that of the high voltage waveform. The low voltage waveform is used to warm filaments (a.k.a. cathodes) 172 and 174 and to maintain the filaments and gases of lamp 170 in an excited state. Thus, the gases in lamp 170 are kept from extinguishing. As discussed below in greater detail, this eliminates the need to repeatedly use high voltage pulses to strike the arc of the lamp as is required in at least some prior art dimmable lamp drive systems. Consequently, the useful lives of both lamp 170 and components of fluorescent lamp drive system 100 are extended. The high voltage waveform received by filament inverter 120 from resonant inverter 110 on outputs 111 and 112 is superimposed on the low voltage waveform on filament inverter outputs 122 and 123 using a double hot spot connection.

Photodiode 140 is of the type well known in the art which provides a voltage output having a magnitude dependent upon the luminance level of lamp 170. The Commanded Brightness signal is a voltage signal controlled by the user or by a separate system or device to achieve a desired luminance from lamp 170. The voltage of the Commanded Brightness input has a predetermined relationship to the voltage output of photodiode 140 when lamp 170 is operating at the corresponding desired luminance. Error amplifier 150 is a conventional operational amplifier which provides an output voltage at output 151 dependent upon a difference in voltage between the Commanded Brightness signal and the output of the photodiode. The output voltage of error amplifier 150 is used by resonant inverter 110 to control the amplitude of the sinusoidal waveform provided to filament inverter 120 for driving lamp 170.

Auto-tune circuit 160 receives frequency feedback signal 161 from resonant inverter 110. Frequency feedback signal 161 is indicative of occurrences of zero crossings of the high voltage waveform generated by resonant inverter 110. Using frequency feedback 161, auto-tune circuit 160 detects occurrences of zero crossings of the high voltage waveform and generates an output signal on auto-tune output 162. The auto-tune circuit output signal is used by resonant inverter 110 to optimize the efficiency of the conversion of power from DC input voltage Vcc to the high voltage waveform used to drive the filaments of lamp 170.

Figure 2:
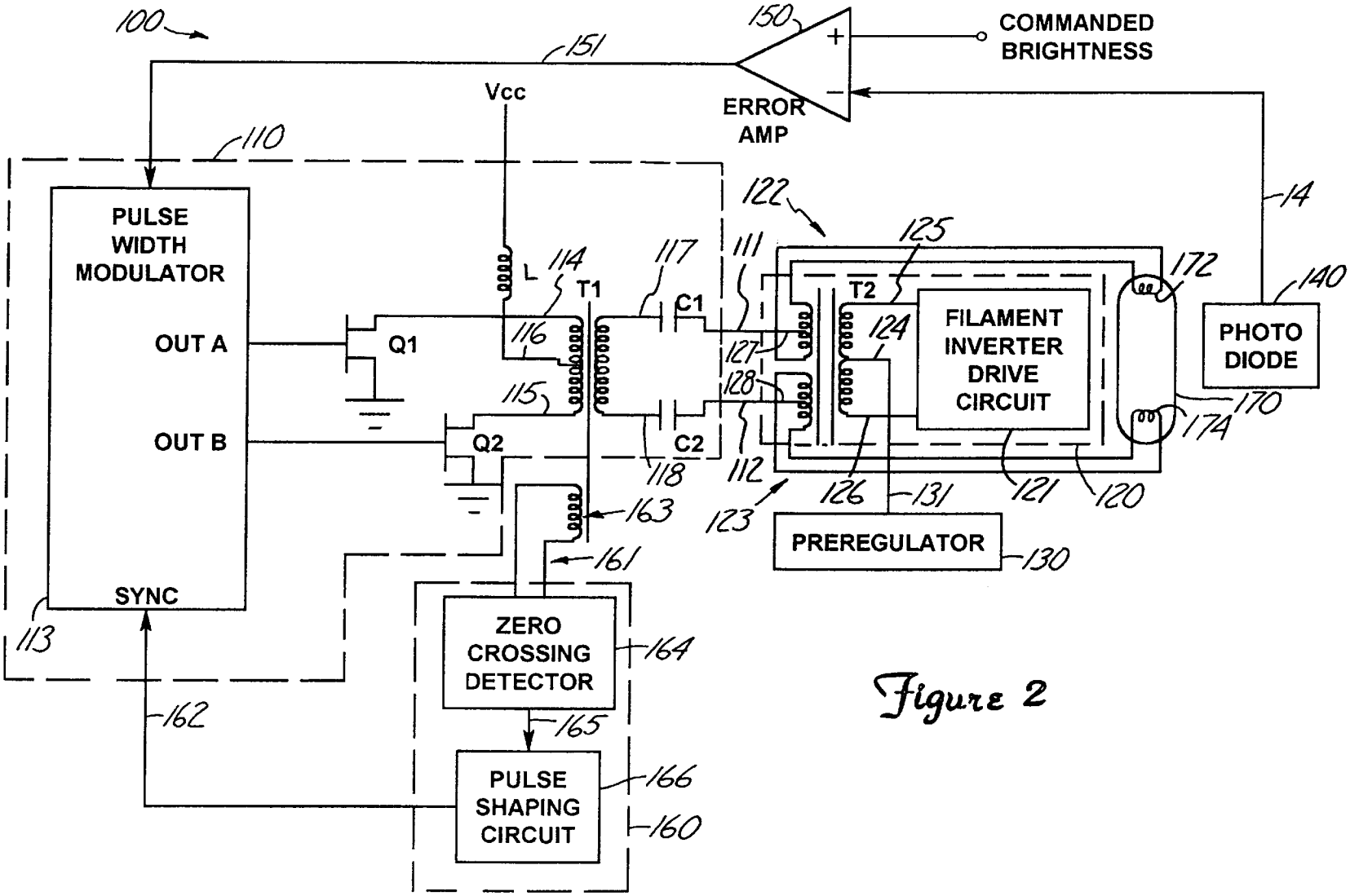
FIG. 2 is a schematic diagram illustrating the fluorescent lamp drive system shown in FIG. 1 in more detail.

FIG. 2 is a schematic diagram illustrating one preferred embodiment of fluorescent lamp drive system 100 in greater detail. It must be noted that although the specific implementation illustrated in FIG. 2 is a preferred implementation, the present invention is not limited to the specific implementation of FIG. 2.

As illustrated in FIG. 2, resonant inverter 110 includes pulse width modulator 113, transistors or semiconductor switches Q1 and Q2, inductor L, transformer T1 and capacitors C1 and C2. DC voltage Vcc is coupled to center tap connection 116 of transformer T1 through inductor L. Pulse width modulator outputs OUTA and OUTB are coupled to the control electrodes of transistors Q1 and Q2, respectively, for controlling conduction of the transistors. The drains of transistors Q1 and Q2 are respectively coupled to inputs or connections 114 and 115 at the primary side of transformer T1. Connections 117 and 118 to the secondary side of transformer T1 are coupled, each through the respective one of capacitors C1 and C2, to outputs 111 and 112 of resonant inverter 110.

When transistor Q1 is conducting, a current path is formed from DC voltage source Vcc, through a first portion of transformer T1, to transistor Q1. When transistor Q2 is conducting, a second current path is formed from DC voltage source Vcc, through a second portion of transformer T1, to transistor Q2. Pulse width modulator 110 uses control signals (sometimes referred to as a gate voltage waveform) at OUTA and OUTB to alternate conduction periods of transistors Q1 and Q2 such that both are not conducting at the same time. The result is that an approximately square wave current waveform is produced in the primary side of transformer T1. This in turn results in the production of the high voltage waveform at the secondary side of transformer T1 and at outputs 111 and 112.

Filament inverter 120 includes transformer T2 and filament inverter drive circuit 121. Output 131 of pre-regulator 130 is coupled to center tap connection 124 of the primary side of transformer T2. Filament inverter drive circuit 121 is coupled to first and second connections 125 and 126 of the primary side of transformer T2. Filament inverter drive circuit 121 performs a function similar to transistors Q1 and Q2 of resonant inverter 110. Filament inverter drive circuit 121 alternates the conduction path from the DC voltage source provided by pre-regulator 131 such that a low voltage drive waveform is generated at the primary windings of transformer T2. The winding ratio of transformer T2 is preferably close to 1:1 so that low voltage waveforms are also generated at connections or outputs 122 and 123 of the secondary of transformer T2. The low voltage waveforms drive filaments 172 and 174 to maintain the gases of lamp 170 in an excited or non-extinguished state. Outputs 111 and 112 of resonant inverter 110 are coupled to center taps 127 and 128 on the secondary of transformer T2 so that the high voltage waveform is superimposed upon the low voltage waveform at outputs 122 and 123, and thus across filaments 172 and 174.

Auto-tune circuit 160 includes zero crossing detector 164 and pulse shaping circuit 166. Input 161 to zero crossing detector 164 is coupled to "tickler" windings 163 on transformer T1. From the waveforms monitored at input 161, zero crossing detector 164 can detect the time at which the high voltage waveform generated by resonant inverter 110 has a zero crossing. This is consequently indicative of zero crossings of the tube or lamp voltage waveform. Output 165 of zero crossing detector 164 is indicative of the occurrence of a zero crossing. Pulse shaping circuit 166 can be any of a variety of well known circuits designed to condition the output of zero crossing detector 164 to meet the requirements of pulse width modulator 113. Output 162 of pulse shaping circuit 166 is therefore a synchronization signal, of appropriate pulse width and height, which is indicative of the concurrent or recent realization of a zero crossing of the high voltage waveform generated by resonant inverter 110. Resonant inverter 110 uses the output of auto-tune circuit 160 to control the conduction of transistors Q1 and Q2 such that they can begin their respective conduction cycles at approximately the same time as a zero crossing of the high voltage waveform. This feature of the present invention, which is discussed further with reference to FIG. 3, optimizes the efficiency of the conversion of power from the DC voltage Vcc to the high voltage sinusoidal waveform.

In operation, fluorescent lamp drive system 100 illustrated in FIGS. 1 and 2 functions generally as follows. Initially, the lamp is powered down and the output of photodiode 140 is correspondingly high. When the Commanded Brightness signal is first applied, the output of error amplifier 150 has a value which causes pulse width modulator 113 to drive transistors Q1 and Q2 at their maximum duty cycle. This causes the voltage generated at outputs 111 and 112 of resonant inverter 110 to ramp up very quickly. The resulting high voltage pulse is transferred through filament inverter 120 to filaments 172 and 174 to strike the arc of lamp 170. As the output luminance of lamp 170 increases, the feedback loop causes resonant inverter 110 to lessen the duty cycle of transistors Q1 and Q2 to clamp down the amplitude of the high voltage waveform to a level corresponding to the desired luminance.

After generation of the high voltage pulse to strike the arc and place the filaments and gases of the lamp into an excited state, filament inverter 120 prevents the gases from extinguishing over a prolonged period of time by providing the low voltage waveform on outputs 122 and 123 to drive filaments 172 and 174, respectively. Through center taps 127 and 128 of transformer T2, the high voltage waveform is superimposed onto outputs 122 and 123 of transformer T2 and thereby drives filaments 172 and 174. The photodiode and error amplifier feedback is maintained to keep the actual luminance intensity approximately equal to the desired luminance intensity. If a change in conditions causes the actual luminance to increase or decrease, the duty cycles of Q1 and Q2 are controlled accordingly to decrease or increase the amplitude of the high voltage waveform and to thereby decrease or increase the actual luminance. Such adjustments are typically necessary when, for example, the magnitude of DC input voltage Vcc increases or decreases.

While filament inverter 120 prevents the gases of lamp 170 from extinguishing and resonant inverter and its associated feedback control the luminance of lamp 170, auto-tune circuit 160 synchronizes the system for the particular impedance of lamp 170. As the impedance of lamp 170 changes with temperature, the frequency of the high voltage waveform used to drive the lamp typically will change as well. Without auto-tune circuit 160, transistors Q1 and Q2 would be switched on during some intermediate point of the high voltage waveform cycle. This would result in inefficient transfer of energy to lamp 170. By synchronizing the conduction times of Q1 and Q2 to begin only at the corresponding zero crossings of the high voltage waveform, power transfer efficiency is optimized.

Figure 3A:
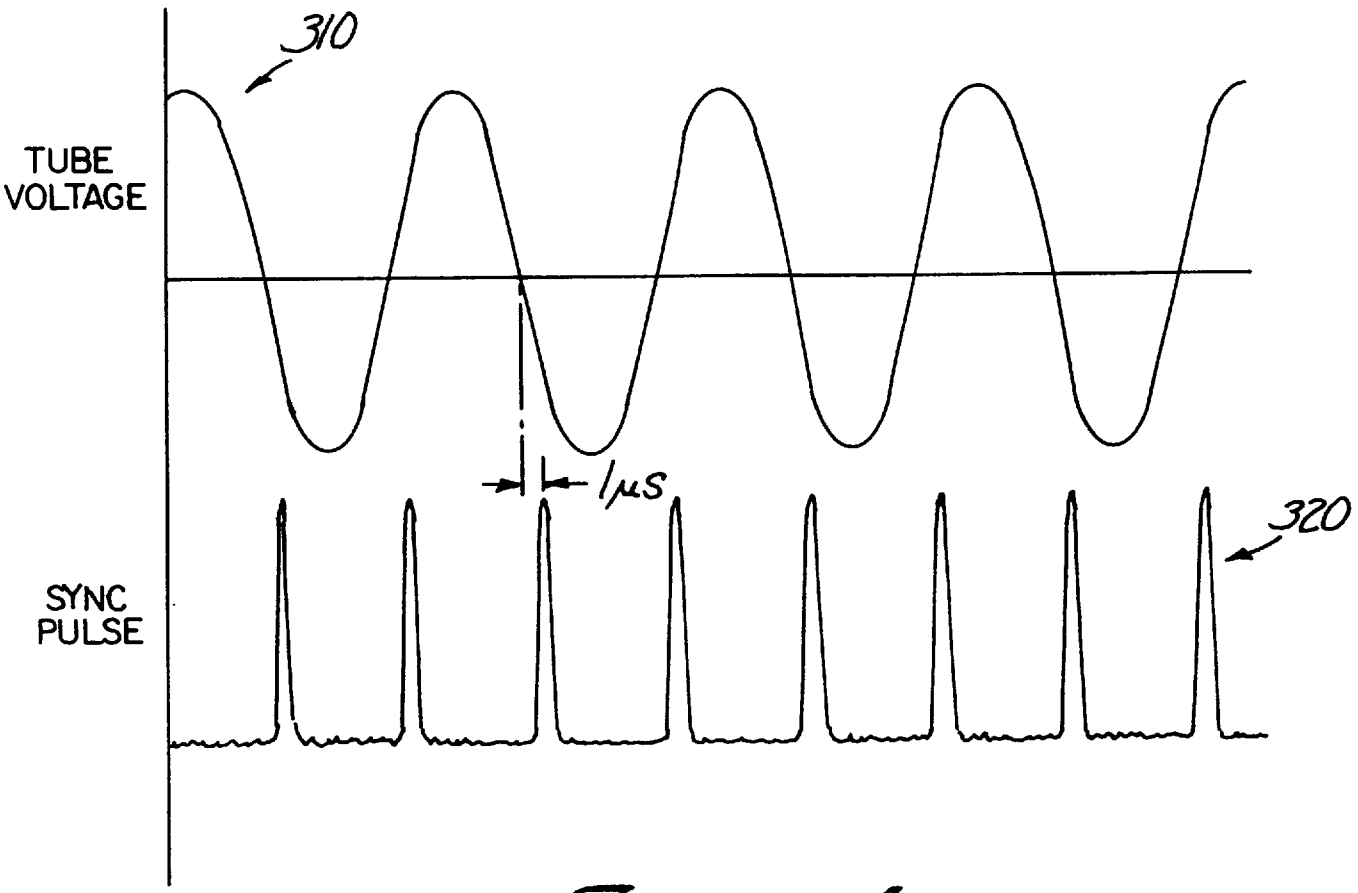
FIGS. 3A and 3B are timing diagrams which illustrate important functional features of the fluorescent lamp drive system of the present invention.
Figure 3B:
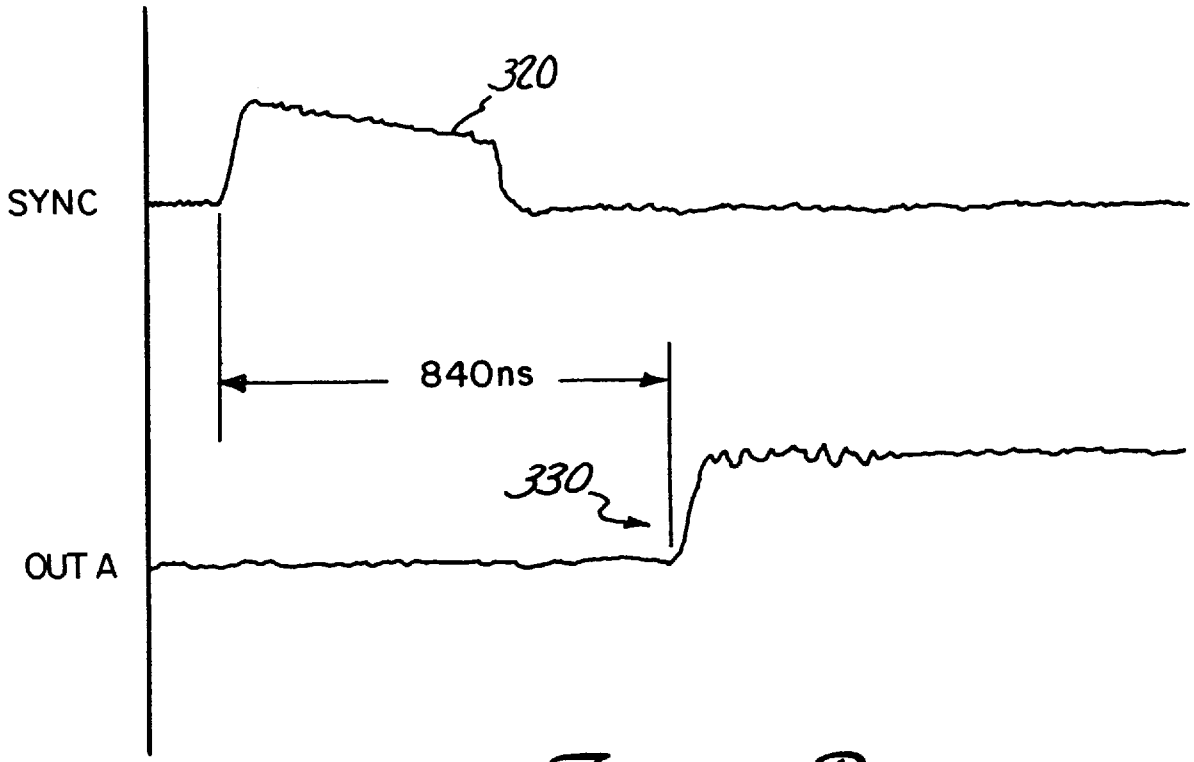

FIGS. 3A and 3B are timing diagrams which illustrate important functional features of the fluorescent lamp drive system of the present invention. FIG. 3A illustrates two waveforms, a "tube voltage" waveform and a "sync pulse" waveform. The tube voltage waveform plots the voltage over time used to drive filaments 172 and 174 of lamp 170. As can be seen in FIG. 3, the tube voltage corresponds to the high voltage waveform (labeled 310) from resonant inverter 110 used to drive fluorescent lamp 170 to the desired luminance level. The low voltage waveform from filament inverter 120 used to ensure that the gases of the fluorescent lamp do not extinguish is not shown in FIG. 3A.

The sync pulse waveform (labeled 320) shown in FIG. 3A corresponds to output 162 of auto-tune circuit 160. Approximately 1 micro-second ($\mu$s) after the occurrence of each zero crossing of high voltage waveform 310, a sync pulse is generated . The 1 $\mu$s delay is due to the limitations of the circuit components. In general, the sync pulse is preferably generated as soon after the presence of a zero crossing as possible. However, it is clear that longer delays can be used without departing from the spirit of the invention.

FIG. 3B illustrates the timing between the occurrence of a sync pulse (labeled 320) and the transition (labeled 330) of the output of pulse width modulator 113 at OUTA. Since only one of transistors Q1 and Q2 conduct at any given time, the waveform for OUTB is not shown. As seen in FIG. 3B, OUTA goes high about 840 nano-seconds (ns) after the rising edge of the sync pulse from auto-tune circuit 160. Once again, the delay is a result of limitations of the circuit components. Shortly after the rising edge of OUTA, transistor Q1 begins conducting and the process of power transfer to lamp 170 is started. By ensuring that energy is converted during the appropriate portion of each cycle, efficiency of the process is optimized.

Figure 4A:
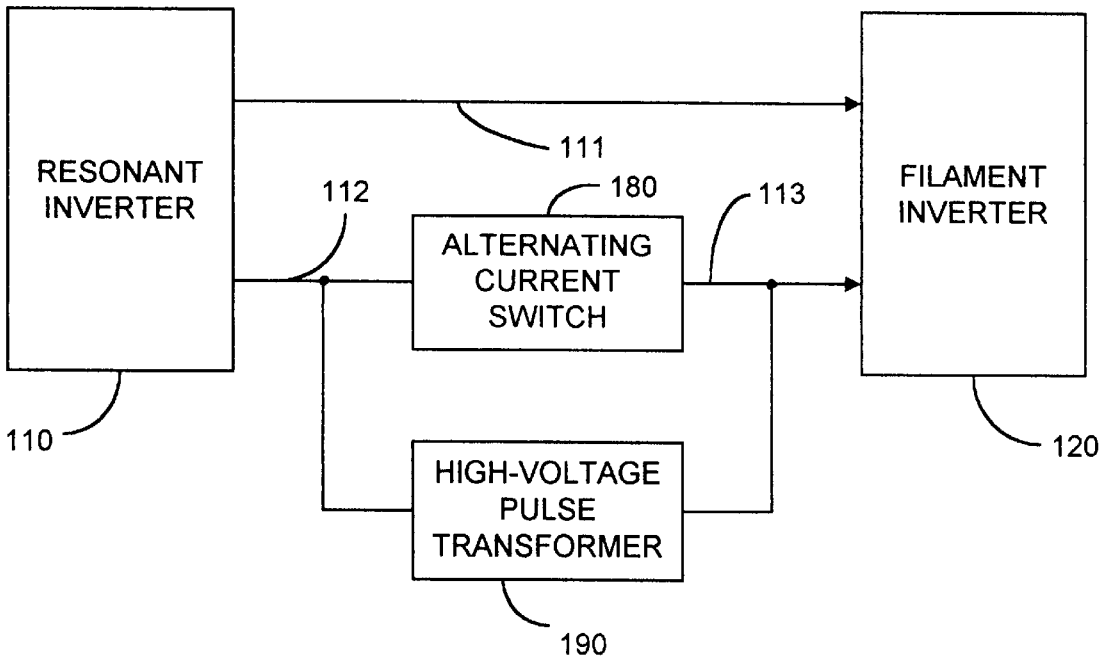
FIG. 4A is a block diagram of an alternative preferred embodiment of a portion of the drive system of FIG. 1.

Now referring to FIG. 4A, there is shown a block diagram of a portion of the system shown in FIG. 1 which includes a high frequency alternating current switch 180 and a high voltage pulse transformer 190 which are in parallel with each other and which together are in series with resonant invertor 110 and filament invertor 120.

Figure 4B:
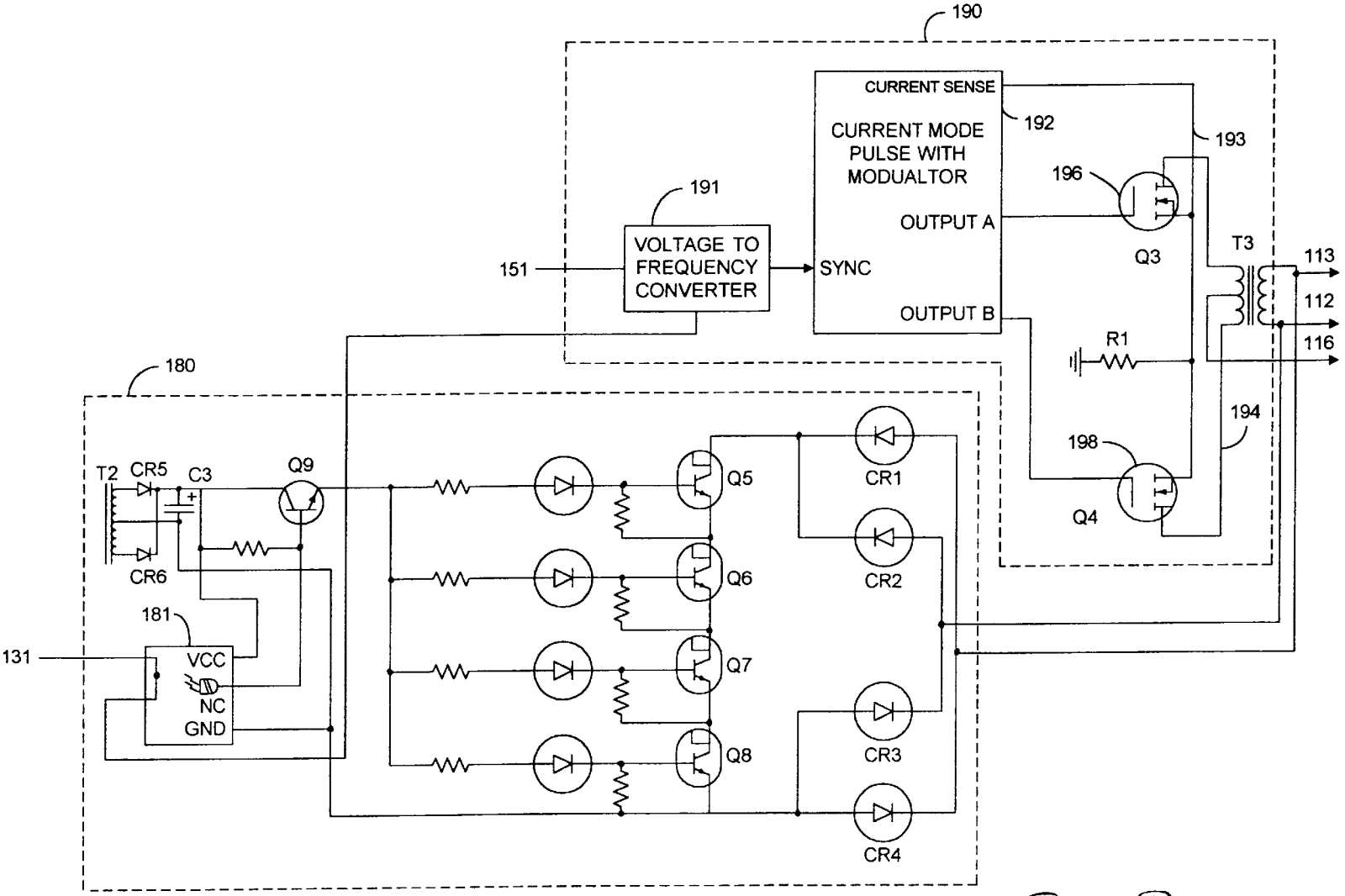
FIG. 4B is a schematic diagram illustrating the portion of the system shown in FIG. 4A.

A more detailed understanding can be obtained by referring now to FIG. 4B which shows block 190 which is a high voltage pulse generator which in one possible embodiment generates 1800 volts for a period of 10–50 microseconds at a frequency between 60 and 10 kilohertz. This is a range which may produce wide luminance dimming ranges. During the time dimming is not required block 180 bypasses the high voltage pulse generator and allows the resonant invertor 110 to drive the fluorescent lamp. As the dimming is required, the switches open and again the current mode pulse width modulator alternates between Q3 and Q4 (which are power MOSFETs 196 and 198, respectively) back and forth at a rate of 60 to 10 kilohertz to achieve a 0.005 foot lamberts on the lamp. As a further note, the resonant invertor and high voltage pulse transformer can operate simultaneously and the periods for which they are on are determined by the actual luminance output required by the lamp. This allows one to have benefits of both systems.

While particular embodiments of the present invention have been shown and described, it should be clear that changes and modifications may be made to such embodiments without departing from the true scope and spirit of the invention. It is intended that the appended claims cover these and other such changes and modifications.

I claim:

1. A fluorescent lamp drive system for supplying power to a fluorescent lamp comprising:

a filament inverter having a transformer comprised of a primary side and a secondary side, coupled to filaments of the fluorescent lamp, the filament inverter driving the filaments of the fluorescent lamp with a first waveform, the first waveform having a voltage amplitude sufficient to excite the filaments of the fluorescent lamp; and a resonant inverter coupled to the filaments of the fluorescent lamp via the filament inverter transformer secondary side, the resonant inverter driving the filaments of the fluorescent lamp with a second waveform, the second waveform having a variable amplitude, wherein controlling the luminance of the fluorescent lamp is achieved by controlling the amplitude of the second waveform.

2. The fluorescent lamp drive system of claim 1, wherein the resonant inverter comprises:

a first transformer, the first transformer having a DC voltage input at a center tap connection of the first transformer;

a first transistor coupled to a primary side of the first transformer, the first transistor providing a first current path from the first transformer when the first transistor is conducting such that current flows from the DC voltage input, through a first portion of the first transformer, to the first transistor;

a second transistor coupled to the primary side of the first transformer, the second transistor providing a second current path from the first transformer when the second transistor is conducting such that current flows from the DC voltage input, through a second portion of the first transformer, to the second transistor; and a pulse width modulator coupled to each of the first and second transistors, the pulse width modulator providing a first output to the first transistor and providing a second output to the second transistor, the first and second pulse width modulator outputs controlling conduction of the first and second transistors, respectively, wherein the second waveform is produced at a secondary side of the first transformer by alternating conduction of the first and second transistors.

3. The fluorescent lamp drive system of claim 2, and further comprising:

an auto-tuning circuit coupled to the resonant inverter, the auto-tuning circuit sensing zero crossings of the second waveform and providing synchronization signals to the pulse width modulator indicative of occurrences of the zero crossings of the second waveform, wherein the pulse width modulator controls the first and second pulse width modulator outputs in response to the synchronization signal so that periods of conduction of the first and second transistors begins at approximately the same times as the occurrences of zero crossings of the second waveform.

4. The fluorescent lamp drive system of claim 3, wherein the auto-tuning circuit comprises:

a zero crossing detector coupled to the first transformer, the zero crossing detector detecting zero crossings of the second waveform and providing a zero crossing output signal indicative of the occurrence of a zero crossings of the second waveform; and a pulse shaping circuit coupled to the zero crossing detector and to the pulse width modulator, the pulse shaping circuit receiving the zero crossing output signal from the zero crossing detector and providing in response the synchronization signals to the pulse width modulator.

5. The fluorescent lamp drive system of claim 1, wherein the first waveform has an amplitude sufficient to maintain gases in the fluorescent lamp in an excited state, wherein the first waveform maintains the gases in the fluorescent lamp in an excited state over a prolonged period of time.

6. The fluorescent lamp drive system of claim 5, wherein the first waveform is a square wave having an amplitude of between about 5 and 8 volts.

7. The fluorescent lamp drive system of claim 1, wherein the second waveform is superimposed upon the first waveform.

8. The fluorescent lamp drive system of claim 7, wherein the second waveform has an amplitude which can be controllably varied between about 250 and 400 volts.

9. The fluorescent lamp drive system of claim 7, wherein the first waveform has a frequency which is approximately half that of a frequency of the second waveform.

10. The fluorescent lamp drive system of claim 3, and further comprising:

a photodiode positioned adjacent to the fluorescent lamp, the photodiode providing a photodiode output signal as a function of luminance of the fluorescent lamp; and comparing means coupled between the photodiode and the pulse width modulator, the comparing means comparing the photodiode output signal to a commanded brightness signal and providing an error signal to the pulse width modulator indicative of a difference in magnitude between the photodiode output signal and the commanded brightness signal, the commanded brightness signal being indicative of a desired luminance of the fluorescent lamp, wherein the pulse width modulator controls the duty cycle of the first and second transistors in response to the error signal and thereby controls the luminance of the fluorescent lamp.

* * * * *